United States Patent [19]

Spevack

[11] Patent Number: 4,519,441

[45] Date of Patent: May 28, 1985

[54] HEAT CONVERSION SYSTEM

[76] Inventor: Jerome S. Spevack, 160 W. Pinebrook Dr., New Rochelle, N.Y. 10804

[21] Appl. No.: 428,652

[22] Filed: Sep. 30, 1982

[51] Int. Cl.[3] ..... F25B 15/00; F25D 21/00

[52] U.S. Cl. ..... 165/1; 62/102; 62/467; 62/476; 165/104.12

[58] Field of Search ..... 165/104.12, 1; 62/112, 62/111, 476, 102, 467 R

[56] References Cited

U.S. PATENT DOCUMENTS

| | | | |
|---|---|---|---|
| 3,967,676 | 7/1976 | Spacil | 165/104.12 |
| 4,167,101 | 9/1979 | Rojey | 165/104.12 |
| 4,410,028 | 10/1983 | Alefeld et al. | 165/104.12 |

OTHER PUBLICATIONS

Wakao et al., *Nitric Acid Cycle Process,* Nature, vol. 273, 5/4/78, pp. 25–27.

*Primary Examiner*—Albert W. Davis, Jr.

[57] ABSTRACT

Thermal energy contained in a flow of hot fluid is employed to produce a heat source liquid at a temperature higher than that of said hot fluid by transferring heat from said hot fluid to a liquid at a relatively low superatmospheric pressure, which liquid contains two chemical substances in combination pursuant to a reversible exothermic chemical reaction, causing said two substances to separate with one remaining in liquid state and the other, which is non-aqueous, volatilizing into gaseous state. The gaseous substance is then separately condensed at said low superatmospheric pressure and the condensate and the said remaining liquid substance are each pumped to a high pressure and then mixed together with the result that the two chemical substances recombine pursuant to said exothermic reaction causing the liquid mixture to heat to a relatively high temperature and thereby produce the said heat source liquid from which heat is transferred to a heat utilizing fluid, e.g. water which is vaporized to produce steam. An illustrative embodiment employs ammonia and water as the two chemical substances which combine to form ammonium hydroxide by a reversible exothermic reaction. Another embodiment operating at a materially higher temperature employs ammonia and molton zinc chloride monammoniacate which combine to form zinc chloride diammoniacate by a reversible exothermic reaction.

17 Claims, 1 Drawing Figure

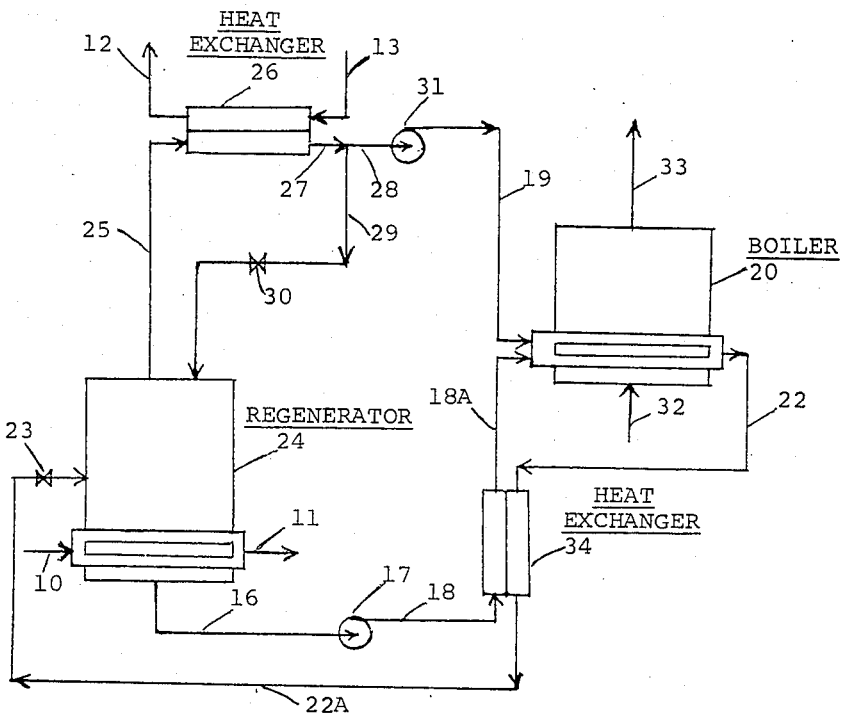
HEAT
EXCHANGER
26
12
13
31
27
28
19
33
25
29
BOILER
20
30
18A
32
22
REGENERATOR
24
23
HEAT
EXCHANGER
34
11
10
17
18
16
22A

HEAT CONVERSION SYSTEM

BACKGROUND OF THE INVENTION

1. Field of the Invention

This invention relates to process and apparatus for converting thermal energy from one temperature level to a higher temperature level. It further relates to the utilization of sensible heat of a hot fluid for the vaporization of a liquid at a temperature of at least approximately that of said hot fluid.

2. Description of the Prior Art

The conversion of thermal energy from one temperature level to a higher temperature level has been carried out by the use of so called heat pumps for the space heating of air. Such heat pumps utilize the work done in vapor compression to provide the increased temperature. A typical system mechanically compresses a refrigerant vapor, e.g. freon, received at one temperature and thereby raises its temperature and pressure. The compressed vapor becomes a source of heat energy at an elevated temperature which can be removed to heat or evaporate another fluid while condensing the vapor to liquid. In the operation of such heat pumps, after said condensation, the condensate is passed to an evaporator at lower pressure where it is vaporized while extracting thermal energy from a suitable heat source, e.g. outdoor air or surface or subsurface water, and the low pressure vapors from the evaporator are pumped by the compressor and recycled. Such source of heat has been employed to warm air in air conditioning systems and the equipment used often is the same refrigeration system as that used for air cooling. Vapor compression has also been used in connection with industrial processes involving boiling, e.g. evaporation and distillation, to recover and recycle heat of vaporization by compressing the vapors to a higher temperature and pressure and employing the compressed vapors as the heat source in a regenerative boiler. An undisclosed proprietary temperature booster requiring a supply of cooling water has been reported by the Battelle Memorial Institute as having been tested and being available by it for use in industrial applications involving the recovery and use of thermal energy from hot liquid flows which otherwise would be discharged to waste, however, no details of the process or apparatus involved have been released.

SUMMARY OF THE INVENTION

The principle purpose of the present invention is to depart from the practice of temperature enhancement based on vapor compression by the known prior art and instead to provide a system which employs reversible exothermic chemical reactions to create higher temperature levels and utilizes thermal energy extracted from a hot fluid at a lower temperature level to regenerate the reactants. One such system is based on the chemical reaction from the solvation of ammonia in water and the formation of ammonium hydroxide. Another system operative in a similar manner but at a much higher temperature range is based on the chemical reaction of ammonia with molten zinc chloride ($ZnCl_2$, melting point approx. 520° F.) or zinc chloride monammoniacate ($ZnCl_2(NH_3)$, melting point approx. 465° F.) to form zinc chloride diammoniacate ($ZnCl_2(NH_3)_2$, melting point approx. 410° F.), the latter compounds also being known in the chemical art as zinc chloride ammoniates or as zinc ammine chlorides.

In practicing the present invention, one portion of the extracted thermal energy is made available as a heat source at the higher temperature level while the other portion is utilized by the temperature enhancement process and dissipated. Depending on engineering and economic considerations, between 20 percent and 80 percent of the thermal energy extracted from a hot fluid may be recovered and utilized at the higher temperature level.

By the present invention, a useful heat source at an increased temperature level is produced from the thermal energy contained in a flow of hot fluid which might otherwise be wasted. This is accomplished with a branched circulation of two fluid chemical substances in which the two substances are processed together in one section of the circulation and processed separately in the branched sections of the circulation. In said processing, one of said substances remains liquid at all times whereas the other substance, which is non-aqueous, exists in liquid and gaseous states at a low pressure and in liquid state at high pressure. The two substances have the capability of combining with an exothermic chemical reaction and the combination may be reversed upon the addition of heat and removal of the gaseous substance. The process extracts heat from said hot fluid and transfers it to the liquid containing both substances in chemical combination at a relatively low pressure, causing the reverse chemical reaction to go to completion as the said other substance is separated in gaseous state from the liquid and withdrawn and then condensed to a liquid by heat exchange with a supply of coolant from an external source. The condensed other substance, now in liquid form, and the separated remaining liquid substance are each separately pumped up to a desired high pressure. The two pressurized liquid substances are mixed together whereupon they engage in said exothermic reaction and generate heat which raises the temperature level of the liquid mixture, thereby producing the heat source at said increased temperature level and providing the thermal energy for utilization according to the invention. For continuous operation, after giving up the thermal energy for said utilization, the liquid mixture is reduced in pressure and recycled for further extraction of heat from hot fluid and separation into its gaseous and liquid components. This invention may be advantageously employed to accept sensible heat from a fluid at a particular temperature and produce steam at a pressure greater than the vapor pressure of water at that temperature.

Among the further objects of the present invention, severally and interdependently, are:

1. To provide an improved system for increasing the temperature level of a supply of thermal energy.

2. To provide a heat pump based on a reversible exothermic chemical reaction between two substances, one of which is non-aqueous and undergoes changes of state between liquid and gas.

3. To provide a system for converting sensible heat of a liquid into heat of vaporization of the same or different liquid at a temperature at least approximately that at which the liquid is supplied.

4. To provide a system for transforming thermal energy of a hot fluid into steam at a pressure at least approximately the vapor pressure of water at the temperature of said hot fluid.

5. To advantageously utilize geothermal waters for the production of steam.

6. To advantageously recover for use sensible heat contained in heated liquid streams which would otherwise be disposed to waste.

Further objects and advantages of the present invention will appear from the detailed description of a preferred embodiment thereof hereinafter presented and as particularly pointed out in the appended claims, said preferred embodiment being illustrative and not restrictive of the scope of the invention disclosed and claimed herein.

BRIEF DESCRIPTION OF THE DRAWINGS

The accompanying drawing is a flow diagram of a system according to a preferred embodiment of the invention for increasing the temperature level of thermal energy extracted from a hot fluid and for producing steam therefrom.

DETAILED DESCRIPTION

In the preferred embodiment of the invention illustrated in the drawing, the system comprises process and apparatus for producing from the sensible heat of a flow of hot fluid in conduit 10, e.g. liquid water at 300° F., steam in conduit 33 at a pressure at least approximately the vapor pressure of water at the temperature at which said hot fluid is supplied. In the illustrated embodiment a flow of liquid water via conduit 18 and a flow of liquid ammonia via conduit 19, supplied at a relatively high pressure, are mixed together before entering the heat source side of boiler 20 to form a solution of ammonium hydroxide with liberation of heat resulting from the exothermic reaction of formation and heat of solution. Said high pressure is determined by the vapor pressure of the ammonia and water solution at a temperature, e.g. 380° F., to be developed by said exothermic heating. As shown, boiler water is supplied via conduit 32 to the heat removal side of boiler 20 and the steam generated therein is withdrawn, e.g. at 300° F., via conduit 33. The cooled ammonia and water solution from boiler 20, e.g. at 320° F., is passed via conduit 22 through pressure reducing means 23 into regenerator 24 which is maintained at a relatively low superatmospheric pressure and temperature, e.g. at about 250 psi and 110° F. Regenerator 24 comprises a heat exchanger that is in the nature of a waste heat boiler. The said flow of hot liquid via conduit 10, is passed through the tubes of the heat exchanger for extraction of sensible heat therefrom and is discharged at a lower temperature via conduit 11. At said relatively low pressure in 24, the heat supplied from the flow in conduit 10 causes the ammonia solution to dissociate with liberation from the liquid of ammonia gas which is withdrawn via conduit 25 to heat exchanger 26 and therein condensed to liquid ammonia, e.g. at 110° F. The heat of vaporization of the ammonia being condensed is removed by heat exchange with a flow of coolant, e.g. water at 85° F., supplied to heat exchanger 26 via conduit 12. The said low superatmospheric pressure of the ammonia section of said regenerator 24 is determined by the vapor pressure of ammonia at its condensation temperature therein. If desired, a portion of the liquified ammonia in conduit 27 may be returned as reflux to regenerator 24 via conduit 29 and control valve 30. In such instance the upper section of regenerator 24 may comprise a conventional countercurrent gas-liquid contact or fractionation section (not shown) whereby such portion of the liquified ammonia serves to partially cool the liberated ammonia gas with return of heat recovered thereby to regenerator 24 and/or to serve as a liquid entrainment seperator. The liquid ammonia in conduit 27 which is not returned to regenerator 24 is pumped by pump 31 to conduit 19 for recycle to said exothermic reaction and delivery to boiler 20, and the liquid, e.g. water or residual ammonia and water solution, remaining in the regenerator 24 is withdrawn via conduit 16 by pump 17 and pumped to conduit 18 for recycle to said exothermic reaction and boiler 20. For improved thermal efficiency of the system, a heat exchanger 34 may be interposed between the flow in conduit 18 and at least a part of the flow in conduit 22. A heat exchanger (not shown) may be similarly interposed between the flow in conduit 19 and the flow in conduit 22. Also, a turbine may be employed in the pressure reducing means 23 to recover mechanical energy, e.g. for use in driving one or both of pumps 17 and 31.

With respect to embodiments of the invention which employ ammonia and molten zinc chloride, except for operation at materially higher temperatures and pressures, the principles applied in the practice thereof are the same as those described above for the embodiment employing ammonia and water. Inherent in such practice is the requirement that the temperature of the hot fluid supplied at 10 and discharged via 11 should sufficiently exceed the melting point of the liquid containing the chemical substances being processed in regenerator 24 so as to maintain the required liquid state of said substances therein.

While there have been described herein what are at present considered preferred embodiments of the invention, it will be obvious to those skilled in the art that modifications, including changes, omissions and substitutions, may be made without departing from the essence and principle of the invention. It is therefore to be understood that the exemplary embodiments are illustrative and not restrictive of the invention, the scope of which is defined by the disclosure and the appended claims herein, and that all modifications that come within the meaning and range of equivalency of the claims are intended to be included therein.

I claim:

1. A process for producing a heat source liquid at a high temperature from thermal energy contained in a flow of hot fluid at a hot temperature lower than said high temperature and for utilizing said heat source, which comprises:

(a) providing a branched circulation of two chemical substances, of which one is non-aqueous and capable of existing in liquid and gaseous states at a low temperature below said hot temperature and the other substance exists in liquid state at said low and high temperatures, and which two substances are capable of undergoing a reversible exothermic reaction of formation of a chemical combination of said two substances in liquid state at either said low temperature and a relatively low superatmospheric pressure corresponding to the vapor pressure of said one substance at said low temperature or said high temperature and a relatively high superatmospheric pressure corresponding to the vapor pressure of said liquid mixture at said high temperature in step (f);

(b) passing said hot fluid in indirect contact heat exchange relation with liquid containing a mixture of said two chemical substances at said low superatmospheric pressure and transferring thermal energy from said hot fluid to the liquid causing said one chemical substance to separate in gaseous state from said liquid while cooling said hot fluid;

(c) passing said one chemical substance separated in gaseous state in step (b) in indirect contact heat exchange relation with a coolant and condensing said separated gaseous substance to liquid state at substantially said low superatmospheric pressure;

(d) pumping liquid condensed in step (c) to said relatively high superatmospheric pressure;

(e) withdrawing liquid remaining after said separation in step (b) and pumping it to said relatively high superatmospheric pressure;

(f) mixing the condensed liquid pumped in step (d) with the liquid pumped in step (e), causing said two chemical substances to undergo said exothermic reaction forming said chemical combination in liquid state and to release thermal energy heating the liquid mixture to said high temperature and producing said heat source therewith;

(g) passing said heat source liquid produced in step (f) in indirect contact heat exchange relation with a heat utilizing fluid and transferring thermal energy to said heat utilizing fluid while cooling said heat source liquid; and (h) passing said cooled liquid from step (g) through means for reducing the pressure thereof from said relatively high superatmospheric pressure to said relatively low superatmospheric pressure and delivering it to step (b) for recycling therein said liquid containing a mixture of said two chemical substances.

2. A process according to claim 1, wherein said one chemical substance is ammonia.

3. A process according to claim 2, wherein said other substance is water.

4. A process according to claim 2, wherein said other chemical substance comprises molten zinc chloride.

5. A process according to claim 1, wherein said heat utilizing fluid is water and steam is produced from the thermal energy transferred in step (g).

6. A process according to claim 5, wherein said steam is at a pressure at least approximately the vapor pressure of water at said hot temperature.

7. A process according to claim 1, which further comprises:

(i) passing a portion of the condensed liquid from step (c) in countercurrent contact with said one chemical substance separated in step (b) and mixing the so contacted liquid with said liquid in step (b).

8. A process according to claim 1, wherein said hot fluid consists essentially of water.

9. A process according to claim 8, wherein said hot fluid is from a geothermal source.

10. A process according to claim 1, which further comprises:

(i) passing said liquid pumped in step (e) in countercurrent heat exchange relation with at least a part of the cooled liquid mixture from step (g) prior to said pressure reduction in step (h).

11. A process according to claim 1, which further comprises:

(i) passing said condensed liquid pumped in step (d) in countercurrent heat exchange relation with at least a part of the cooled liquid mixture from step (g) prior to said pressure reduction in step (h).

12. A process according to claim 1, which further comprises:

(i) producing mechanical power from said pressure reduction in step (h) and utilizing such power to provide at least a part of the power required for said pumpings in steps (d) and (e).

13. A process according to claim 1, wherein said thermal energy transferred to said heat utilizing fluid in step (g) is at least 20 percent of the thermal energy which was transferred from said hot fluid in step (b).

14. A process according to claim 2, wherein said other chemical substance comprises molton zinc chloride monammoniacate.

15. A process according to claim 2, wherein said chemical combination consists essentially of zinc chloride diammoniacate.

16. Apparatus for producing a heat source liquid at a high temperature from thermal energy contained in a flow of hot fluid at a hot temperature lower than said high temperature and for utilizing said heat source, which comprises:

(a) indirect contact heat exchange means comprising (1) in the heat supply side thereof, an inlet for receiving said hot fluid and an outlet for discharging cooled hot fluid, and (2) in the heat accepting side thereof, a liquid inlet for receiving at the relatively low superatmospheric pressure required in the means (b) liquid comprising a mixture of two chemical substances one of which is non-aqueous and capable of existing therein in gaseous state at a low temperature below said hot temperature, means for separating said one chemical substance in gaseous state from said liquid at said low superatmospheric pressure, a gas outlet for withdrawing said separated gaseous substance, and a liquid outlet for discharging the remaining liquid comprising said other substance;

(b) indirect contact condenser means comprising (1) in the heat supply side thereof, a gas inlet connected to said gas outlet of the means (a), means for condensing said one chemical substance in gaseous state to liquid at said low temperature and a low superatmospheric pressure corresponding to the vapor pressure of said one substance at said low temperature, and a liquid outlet for removing said condensed one chemical substance in liquid state, and (2) in the heat accepting side thereof, a coolant inlet and outlet for receiving and discharging a flow of coolant;

(c) condensate pump means comprising an inlet connected to said liquid outlet in the means (b), and means for pumping the condensed liquid therefrom to a relatively high superatmospheric pressure corresponding to the vapor pressure of said liquid mixture at said high temperature and for delivering it to the means (e);

(d) liquid pump means comprising an inlet connected to said liquid outlet in the means (a), and means for pumping the liquid therefrom to said relatively high superatmospheric pressure and delivering it to the means (e);

(e) mixing means comprising outlets connected to said condensate pump means and to said liquid pump means for receiving and mixing the liquid discharges from both said pump means at said relatively high superatmospheric pressure and causing said two chemical substances therein to interact releasing thermal energy and heating the liquid mixture to said high temperature and producing said heat source liquid therewith;

(f) indirect contact heat transfer means comprising (1) in the heat supply side thereof, inlet means for receiving said heat source liquid from the means (e) and a liquid outlet for discharging the cooled heat source liquid after transfer of thermal energy therefrom, and (2) in the heat utilization side thereof, means for receiving and discharging a heat utilizing fluid; and (g) pressure reducing and recycling means connecting said liquid outlet in the means (f) to said liquid inlet in the means (a) for reducing the pressure of said cooled liquid from said high superatmospheric pressure to said low superatmospheric pressure and for recycling said liquid mixture of said two substances to said liquid inlet in the means (a).

17. Apparatus according to claim 16, which further comprises:

(h) indirect contact heat exchanger means comprising (1) in the heat supply side thereof, an inlet and an outlet connected between said liquid mixture outlet in the means (f) and said means for reducing the pressure thereof in the means (g), and (2) in the heat receiving said thereof, an inlet and an outlet connected between the delivery means of said liquid pump means and said means for receiving the liquid discharges from said pumps of the means (e).

* * * * *